United States Patent [19]

Khare

[11] Patent Number: 4,608,851

[45] Date of Patent: Sep. 2, 1986

[54] WARM-WORKING OF AUSTENITIC STAINLESS STEEL

[75] Inventor: Ashok K. Khare, Warren, Pa.

[73] Assignee: National Forge Co., Irvine, Pa.

[21] Appl. No.: 794,265

[22] Filed: Nov. 1, 1985

Related U.S. Application Data

[63] Continuation of Ser. No. 592,784, Mar. 23, 1984, abandoned.

[51] Int. Cl.[4] ..... B21J 1/06

[52] U.S. Cl. ..... 72/364; 148/12 E

[58] Field of Search ..... 72/364, 377, 700; 148/12 E

[56] References Cited

U.S. PATENT DOCUMENTS

| | | | |
|---|---|---|---|
| 2,080,640 | 5/1937 | Templin | 72/377 |
| 2,846,905 | 8/1958 | Lichtenfeld | 72/420 |
| 2,880,855 | 4/1959 | Nachtman | 205/21 |
| 2,953,794 | 9/1960 | Klooz | 10/27 |
| 3,320,102 | 5/1967 | Murphy et al. | 148/131 |
| 3,476,616 | 11/1969 | Dulis | 148/12 E |
| 3,752,709 | 8/1973 | Zackay et al. | 148/12 E |
| 3,841,139 | 10/1974 | Bachmann | 72/420 |
| 3,871,925 | 3/1975 | Nunes | 148/12 E |
| 3,877,281 | 4/1975 | Shimizu et al. | 72/364 |
| 3,889,510 | 6/1975 | Yamakoshi et al. | 72/364 |
| 4,222,260 | 9/1980 | McDermott | 72/345 |
| 4,450,008 | 5/1984 | Andreini et al. | 75/128 A |

*Primary Examiner*—Lowell A. Larson

*Attorney, Agent, or Firm*—Wayne M. Kennard

[57] ABSTRACT

A process for warm-working a forged austenitic stainless steel workpiece to improve its mechanical and physical properties is disclosed. The workpiece is subjected to a force great enough to cause deformation while the surface temperature of the workpiece is elevated in the range of above about 200° F. (95° C.) to below the lower critical temperature. The purpose of using elevated temperatures is to reduce the force required to deform the workpiece. Stabilized austenitic stainless steel can be warm-worked and still maintain its corrosion-resistant properties. The advantages of warm-working over cold-working to achieve properties are reduction of noise and improved metallurgical control.

8 Claims, No Drawings

WARM-WORKING OF AUSTENITIC STAINLESS STEEL

This is a continuation of application Ser. No. 592,784, filed Mar. 23, 1984, entitled Warm-Working of Austenitic Stainless Steel, now abandoned.

TECHNICAL FIELD OF INVENTION

This invention relates to austenitic stainless steel and to a method for improving the physical and mechanical properties of such steel.

BACKGROUND OF THE INVENTION

After forging, austenitic stainless steel must be treated to develop the desired physical and mechanical properties, such as strength or hardness. Strength is given to steel by stressing it which causes local areas of strain. In general, stress can be caused by (1) mechanically working the steel, such as by cold-working, to cause a decrease in grain size or (2) heat treating the steel from above the lower critical temperature to cause structural transformations in the steel. Austenitic stainless steel, however, is not hardenable by heat treatment and typically must be cold-worked to develop mechanical and physical properties.

Inherent in the cold-working process, however, are problems of noise control and metallurgical control. The cold-working process is very noisy, typically involving a steam hammer constantly pounding a workpiece. In addition, the mechanical and physical properties of the workpiece are dependent on the amount of cold-working. The amount of cold-working required to achieve particular properties is difficult to control. Too much cold-working can lead to irreversible damage to a workpiece by making it too hard and decreasing its corrosion-resistance. In addition, insufficient cold-working will not give desired properties and requires rework of the material resulting in undue delays in processing.

SUMMARY OF THE INVENTION

It is therefore an object of the invention to develop the mechanical and physical properties of austenitic stainless steel while maintaining an acceptable noise level and controlling the amount of working of the steel.

According to the warm-working process of the present invention, the mechanical and physical properties of a forged austenitic stainless steel workpiece are developed by subjecting the workpiece to a force sufficient to cause deformation while the workpiece has a surface temperature in the range above about 200° F. (95° C.) and below the lower critical temperature. (It will be noted that all conversations of °F. to °C. are rounded to the nearest 0° C. or 5° C.) The workpiece is progressively moved along in steps on open-die forging equipment while working between the two dies of such equipment at each step, rotating the workpiece at each step to correct any distortion caused by previous working. Where corrosion-resistant properties are desired in the final workpiece, a stabilized austenitic stainless steel should be used.

DETAILED DESCRIPTION OF THE INVENTION

According to the process of the present invention, a forged austenitic stainless steel workpiece is "warm-worked" to achieve desired mechanical and physical properties. While "hot-working" is defined as working steel above the temperature of recrystallization and "cold-working" as working steel below the temperature of recrystallization, "warm-working" falls in a gray area in between. Warm-working of austenitic stainless steel is normally performed in the range above about 200° F. (95° C.) and below the lower critical temperature. The purpose of working the stainless steel at temperatures higher than room temperature is to reduce the force required to work the steel and to provide deformation into the material with relative ease.

A workpiece to be warm-worked according to the present invention can be forged from austenitic stainless steel to the desired dimensions. Forging takes place in the temperature range of about 1700° to 2300° F. (925° to 1260° C.). The workpiece is allowed to air cool until a surface temperature of about 1200° F. (650° C.) is reached. Warm-working according to the presnet invention is then performed on open-die forming equipment having flat or "V" dies.

The surface temperature of the workpiece governs the force needed for warm-working. For example, using a 3000 ton (2720 tonnes) capacity press, warm-working can be performed in the range of about 850° to 1200° F. (455° to 650° C.). The lower the surface temperature of the workpiece, the greater is the forced needed to deform the workpiece. Thus, using a press with great enough capacity, warm-working can be performed at any temperature above room temperature, preferably above about 200° F. (95° C.), and below the lower critical temperature.

The warm-working process is performed in steps, the step size being dependent on the width of the dies. At each step, the workpiece is worked in a first direction between the dies. This can cause the workpiece to become deformed in a second direction. Therefore, the workpiece, which is held by a manipulator at one end, is rotated and worked in the second direction to correct this deformation. The working and rotation steps can be repeated in any necessary direction and as many times as desired. However, because it is most economical to perform the warm-working process while the workpiece is cooling down, the number of working and rotation steps is normally limited so that the entire length of the workpiece can be warm-worked while still at elevated temperatures. Normally, it is only necessary to work in two directions at each step to maintain the original outer circumferencial shape of the workpiece and to achieve the improved mechanical and physical properties. The workpiece is progressively moved through the dies by the manipulator, warm-working at each step in the manner just described, until the entire length of the workpiece is warm-worked.

While the whole class of austenitic stainless steel (AISI 300 series) can be warm-worked as described above, certain members of the series may be chosen for particular applications. For example, the non-stabilized grades, such as Type 304, become sensitized during warm-working, due to exposure to elevated temperatures, as a result of the precipitation of chromium carbides at the grain boundaries. This causes a loss of corrosion-resistance. This loss can be prevented by using stabilized austenitic stainless steel, such as Type 321. This stabilized austenitic stainless steel has titanium which bonds with carbon so that the chromium cannot form chromium carbides. Therefore, it is preferred that stabilized austenitic stainless steels be warm-worked when corrosion-resistance is required in the finished product. Such stabilized austenitic stainless steels are adaptable for use in highly corrosive environments, such as in sea water, and can be used, for example, for making submarine periscope tubes and taper sections.

EXAMPLE

An ingot of Type 321 steel having the following final ladle chemistry was forged on an open-die forging press having a 3000 ton (2720 tonnes) capacity into a workpiece having a diameter of 10 inches (25 cm.) and a length of about 22 feet (7 m. ):

| C | Mn | P | S | Si | Ni | Cr | Mo | Ti |
|---|---|---|---|---|---|---|---|---|
| 0.07 | 1.68 | 0.021 | 0.006 | 0.62 | 10.91 | 18.03 | 0.15 | 0.36 |

After forging, the workpiece was allowed to air cool, away from the press, to 1200° F. (650° C.). The workpiece was then moved back to the press for warm-working. A 10 foot (3 m.) section was warm-worked according to the present invention. The width of each top and bottom flat die of the open-die forging press was 12 inches (30 cm.). The workpiece was moved along in steps, each step having a length approximately equal to the width of the dies, until the entire length of the 10 foot (3 m.) section was warm-worked. At each step, the workpiece was squeezed between the two dies, rotated approximately 90° around the long dimension of the workpiece, and squeezed again to correct any distortion caused by the first squeezing. The workpiece temperature was 1040° F. (560° C.) at the start and 850° F. (455° C.) at the finish of the warm-working operation. The workpiece was then allowed to air-cool to room temperature. The warm-worked 10 foot (3 m.) section was sawed off from the rest of the workpiece. A 6 inch (15 cm.) section was sawed off from the 10 foot (3 m.) section and tested for mechanical and physical properties.

Tensile strength, proof stress, elongation, reduction of area, and modulus of elasticity were each measured along a diameter of the 6 inch (15 cm.) cut section. The results are shown in Table 1. Location 1 is closest to the outer surface of the workpiece with locations 2, 3 and 4 being progressively closer to the center of the workpiece. "A" and "B" denote points 180° apart at each location.

TABLE 1

| | | Tensile Strength KSI | | Proof Stress 0.01% KSI | | Elongation % | | Reduction of Area % | | Modulus of Elasticity psi × $10^6$ | |
|---|---|---|---|---|---|---|---|---|---|---|---|
| Location | | Value | Avg. | Value | Avg. | Value | Avg. | Value | Avg. | Value | Avg. |
| 1 | A | 102.0 | | 61.0 | | 42.5 | | 71.0 | | 32.6 | |
| | | | 100.6 | | 59.6 | | 39.8 | | 70.7 | | 31.9 |
| | B | 99.2 | | 58.1 | | 37.0 | | 70.4 | | 31.2 | |
| 2 | A | 95.5 | | 60.0 | | 48.0 | | 70.4 | | 33.0 | |
| | | | 94.8 | | 60.6 | | 47.5 | | 70.4 | | 33.4 |
| | B | 94.2 | | 61.2 | | 47.0 | | 70.4 | | 33.7 | |
| 3 | A | 96.0 | | 58.5 | | 50.5 | | 70.4 | | 31.7 | |
| | | | 94.5 | | 59.0 | | 50.0 | | 70.5 | | 32.1 |
| | B | 93.0 | | 59.5 | | 49.5 | | 70.6 | | 32.5 | |
| 4 | A | 94.6 | | 60.9 | | 48.0 | | 68.6 | | 33.5 | |
| | | | 95.0 | | 60.0 | | 49.5 | | 69.6 | | 33.4 |
| | B | 95.5 | | 59.2 | | 51.0 | | 70.5 | | 33.2 | |

A through thickness Brinell hardness test was conducted on a 1 inch (25 mm.) thick slice sawed off from the workpiece. The hardness tests were conducted at ½ inch (13 mm.) intervals across the diameter of the slice. The Brinell hardness ranged from a high of 255 at the outside diameter of the slice to a low of 207 at the center.

A corrosion test was performed on two longitudinal specimens from the workpiece. The specimen size was ⅛ inch (3 mm.) thick, ½ inch (13 mm.) wide, and 4.00 inches (102 mm.) long. The composition of the boiling solution was:

Copper Sulfate: 13 grams
Sulfuric Acid: 47 milliliters
Water: 1000 milliliters

The samples were boiled in this solution for 72 hours and then bent 180° to a radius not greater than its thickness. After bending, the samples were checked for cracks and none were found.

Magnetic permeability was between 1.01 and 1.10.

It is to be understood that while the invention has been described with respect to the preferred embodiments, variations and equivalents thereof may be perceived by those skilled in the art while nevertheless not departing from the scope of my invention as set forth in the claims appended hereto.

I claim:

1. A process for developing the mechanical and physical properties of an austenitic stainless steel workpiece, the process comprising the steps of:

(1) hot working the workpiece;

(2) continuously cooling the workpiece from its hot working temperature to a temperature below 200° F. (95° C.); and (3) warm working the workpiece by subjecting it to a force sufficient to achieve said properties during said continuously cooling step while the workpiece has a surface temperature in the range above 200° F. (95° C.) and below the lower critical temperature, with both said hot working and warm working steps being carried out in a single heating cycle.

2. The process as claimed in claim 1 wherein subjecting the workpiece to said force comprises progressively moving the workpiece by steps through a pair of dies, the dies having a die width, each step being approximately the length of the die width, and working the workpiece between the dies at each step.

3. The process as claimed in claim 2 wherein the workpiece has a long dimension and a cross-sectional shape perpendicular to the long dimension and the workpiece is rotated a predetermined amount about its long dimension at each step to a position whereby the workpiece is subjected to sufficient force to correct any distortion in the cross-sectional shape caused by the previous working step.

4. The process as claimed in claim 12 wherein the cross-sectional shape is circular.

5. The process as claimed in claim 1 wherein the surface temperature of the workpiece ranges between 850° to 1200° F. (455° to 650° C.).

6. The process as claimed in claim 1 wherein the austenitic stainless steel is Type 321 and remains corrosion-resistant after warm-working.

7. A process of warm-working for developing the mechanical and physical properties of an austenitic stainless steel workpiece, the workpiece having a long dimension and a cross-sectional shape perpendicular to the long dimension, the process comprising the steps of:

(1) hot working the workpiece;

(2) continuously cooling the workpiece from its hot working temperature to a temperature below 200° F. (95° C.);

(3) warm working the workpiece by progressively moving the workpiece along its long dimension during said continuously cooling step by steps through a pair of dies, with the respective dies having substantially equal widths on an open forging press, each step being approximately the length of the die width;

(4) at each step:

(a) Squeezing the workpiece at a first position;

(b) rotating the workpiece a predetermined amount about its long dimension to a second position; and (c) squeezing the workpiece between the dies when said workpiece is in said second position;

(5) carrying out steps (3) and (4) while the surface temperature of the workpiece is between 850° and 1250° Fahrenheit (455°l to 650° C.); and (6) carrying out steps (1), (3) and (4) during a single heating cycle.

8. A process as claimed in claim 7 wherein the austenitic stainless steel is Type 321.

* * * * *

UNITED STATES PATENT AND TRADEMARK OFFICE

CERTIFICATE OF CORRECTION

PATENT NO. : 4,608,851

DATED : Sep. 2, 1986

INVENTOR(S) : Ashok Khare

It is certified that error appears in the above-identified patent and that said Letters Patent is hereby corrected as shown below:

Column 1, line 55, "conversation" should be --conversions--

Column 2, line 18, "presnet" should be --present--

Column 2, line 27, "forced" should be --force--

Column 5, line 1, "12" should be --2--

Column 6, line 14, "(455°1)" should be --(455° to 650°C)--

Signed and Sealed this

Twenty-second Day of March, 1988

*Attest:*

DONALD J. QUIGG

*Attesting Officer*

*Commissioner of Patents and Trademarks*